US011136722B2

(12) United States Patent
Lackinger-Csarmann et al.

(10) Patent No.: US 11,136,722 B2
(45) Date of Patent: Oct. 5, 2021

(54) METHOD FOR MANUFACTURING PAPER OR BOARD AND PAPER OR BOARD PRODUCT

(71) Applicant: Kemira Oyj, Helsinki (FI)

(72) Inventors: Elisabeth Lackinger-Csarmann, Krems (AT); Johannes Fallmann, Theiß (AT); Alexander Wahl, Vienna (AU); Thomas Schwind, Vienna (AT); Jürgen Sartori, Krems (AT); Samuel Okoli, Krems (AT)

(73) Assignee: Kemira Oyj, Helsinki (FI)

( * ) Notice: Subject to any disclaimer, the term of this patent is extended or adjusted under 35 U.S.C. 154(b) by 89 days.

(21) Appl. No.: 16/496,975

(22) PCT Filed: Mar. 26, 2018

(86) PCT No.: PCT/FI2018/050225
§ 371 (c)(1),
(2) Date: Sep. 24, 2019

(87) PCT Pub. No.: WO2018/178513
PCT Pub. Date: Oct. 4, 2018

(65) Prior Publication Data

US 2021/0102342 A1 Apr. 8, 2021

(30) Foreign Application Priority Data

Mar. 27, 2017 (FI) ..... 20175282

(51) Int. Cl.

| | |
|---|---|
| ***D21H 21/16*** | (2006.01) |
| ***D21H 11/14*** | (2006.01) |
| ***D21H 17/02*** | (2006.01) |
| ***D21H 17/15*** | (2006.01) |
| ***D21H 17/67*** | (2006.01) |
| ***D21H 17/00*** | (2006.01) |
| ***D21H 27/10*** | (2006.01) |
| ***D21H 27/22*** | (2006.01) |

(52) U.S. Cl.
CPC ..... *D21H 21/16* (2013.01); *D21H 11/14* (2013.01); *D21H 17/02* (2013.01); *D21H 17/15* (2013.01); *D21H 17/675* (2013.01); *D21H 17/74* (2013.01); *D21H 27/10* (2013.01); *D21H 27/22* (2013.01)

(58) Field of Classification Search
USPC ..... 162/179
See application file for complete search history.

(56) References Cited

U.S. PATENT DOCUMENTS

| | | | | |
|---|---|---|---|---|
| 5,972,100 | A | 10/1999 | Dumas | |
| 8,512,521 | B2 * | 8/2013 | Lackinger | D21H 21/16 162/179 |
| 2004/0089433 | A1 | 5/2004 | Propst et al. | |
| 2004/0121093 | A1 | 6/2004 | Ogino et al. | |
| 2006/0049377 | A1 | 3/2006 | Goldsberry, III et al. | |
| 2006/0231223 | A1 | 10/2006 | Ward et al. | |

FOREIGN PATENT DOCUMENTS

| | | | |
|---|---|---|---|
| EP | 2239369 | A1 | 10/2010 |
| WO | 2004059082 | A1 | 7/2004 |
| WO | 2006002867 | A1 | 1/2006 |
| WO | 2010116044 | A1 | 10/2010 |

OTHER PUBLICATIONS

Finnish Patent and Registration Office, Search Report of FI20175282, dated Nov. 7, 2017, 1 page.

* cited by examiner

*Primary Examiner* — Mark Halpern
(74) *Attorney, Agent, or Firm* — Meunier Carlin & Curfman LLC

(57) ABSTRACT

A manufacturing method of a paper, board or the like having a grammage in a range of 125-600 g/m$^2$, preferably 150-210 g/m$^2$, including adding a paper sizing agent including maleated vegetable oil and an alkenyl succinic anhydride (ASA) to a fibre stock including at least 80 weight-% of recycled fibre material and having calcium concentration of at least 500 mg/l, expressed as CaO.

19 Claims, 1 Drawing Sheet

METHOD FOR MANUFACTURING PAPER OR BOARD AND PAPER OR BOARD PRODUCT

PRIORITY

This application is a U.S. national application of the international application number PCT/FI2018/050225 filed on Mar. 26, 2018 and claiming priority of Finnish application 20175282 filed on Mar. 27, 2017 the contents of all of which are incorporated herein by reference.

FIELD OF THE INVENTION

The present invention relates to a method for manufacturing a paper, board or the like according to the independent claim presented below. The invention relates also to the paper or board product manufactured by the method according to the invention.

BACKGROUND OF THE INVENTION

Sizing of paper or board is used to hinder penetration of water into the sheet. This repellence is needed for e.g. durability of a paper or a paper board. Hydrophobation of the fibre can be achieved by a modification of the fibre constitution in the paper or board. Molecules which are able to attach to the fibres with one side and hinder the penetration of water with the other side are added to the fibre stock during the papermaking process. When paper or board is sized in this way it is called internal sizing.

The alkenyl succinic anhydride (ASA) is a common internal sizing agent. It is synthesized from olefins and maleic anhydride as raw materials.

The maleated vegetable oil, such as maleated sunflower oil, was developed as a sizing agent based on renewable raw materials whereas a conventional alkenyl succinic anhydride (ASA) is manufactured from fossil based olefins. A paper sizing emulsion comprising a maleated vegetable oil is presented in the publication WO2010/116044.

In manufacturing of paper and board the use of inexpensive fibre sources, such as recycled fibre materials, has been increasing over the past decades. Recycled fibre materials may introduce significant levels of detrimental substances to the papermaking process. This may include ash originating from coating pigments and fillers, starch, sizing agents, dissolved and colloidal substances and anionic trash Thus, these kinds of fibre stocks originating mostly in recycled fibres have typically a high calcium load, and it might induce the formation of bonds between calcium and ASA which will be lost for sizing when using ASA as an internal sizing agent.

Thus, there is a need for sizing chemical systems providing improved sizing efficiency and preferably tolerating high calcium load of the fibre stock without substantial performance loss.

SUMMARY OF THE INVENTION

It is an object of the present invention to reduce or even eliminate the drawbacks existing in prior art.

It is an object of the present invention to provide a method for producing a paper or board, which method provides an improved sizing efficiency. Especially, it is an object of the present invention to provide a method for producing a paper or board having a grammage in the range of 125-600 g/m$^2$, preferably 150-210 g/m$^2$ with an improved sizing efficiency.

Another object of the invention is to provide a sizing agent program for a paper or board production which uses mostly renewable fibre resources and provides an improved sizing result.

In order to achieve among others the objects presented above, the invention is characterized by what is presented in the enclosed independent claim.

Some preferred embodiments of the invention will be described in the other claims.

The embodiments and advantages mentioned in this text relate, where applicable, both to the product and the method according to the invention, even though it is not always specifically mentioned.

Typical method according to the invention for manufacturing paper, board or the like having a grammage in the range of 125-600 g/m$^2$, preferably 150-210 g/m$^2$, comprising

- introducing a fibre stock comprising at least 80 weight-% of recycled fibre material, calculated as dry, and having calcium concentration of at least 500 mg/l, expressed as CaO,
- adding a paper sizing agent comprising an alkenyl succinic anhydride (ASA) and at least 30-60 weight-% of a maleated vegetable oil to the fibre stock, and
- forming the fibre stock into fibrous web and drained to the paper, board or the like.

Typical paper product, board product or the like according to the invention having a grammage in the range of 125-600 g/m$^2$, preferably in the range of 150-210 g/m$^2$ and it is manufactured by the method according to the invention. The paper or board product according to the invention has noted an improved resistance against wetting. According to one preferred embodiment of the invention, the paper or board product is a gypsum board paper. The method according to the invention makes possible to manufacture a gypsum board paper with improved resistance to wetting from the recycled fibre materials. Thus, the present invention provides cost-effective method for manufacturing paper or board product with improved sizing efficiency, especially manufacturing of a gypsum board paper with improved sizing efficiency.

It has been surprisingly found that the use of maleated vegetable oil, such as maleated high oleic sunflower oil, is beneficial for fibre stocks originating mostly from recycled fibre material in combination with an alkenyl succinic anhydride (ASA) for improving sizing efficiency. It has been found that maleated vegetable oil boosts the ASA sizing efficiency for these certain fibre stocks comprising at least 80 weight-% of recycled fibre material and characterized by a high calcium load. The efficiency of the sizing agent can be analysed by testing paper or board resistance to water. One typical way to determine sizing efficiency is the $Cobb_{60}$ test: the amount of water is measured which is absorbed by a standardized paper area during a fixed period of time. The sizing efficiency decreases with the amount of water retained in the paper sheet. The sizing efficiency may also be tested by using a so-called floating test, wherein penetration of water to the sheet after 120 minutes floating at 90° C. water is analysed.

Synergistic effect of ASA and maleated vegetable oil is especially observed with the fibre stocks comprise at least 80 weight-%, preferably at least 90 weight-% and more preferably 100 weight-% of recycled fibre material. In a preferred embodiment of the invention, the fibre stock does not contain any fresh fibres, but it contains only recycled fibres from waste paper or board. These kinds of fibre stocks originating mostly from recycled fibres have typically a high calcium load, and it might induce the formation of Ca-ASA which will be lost for sizing. Now, the maleated vegetable oil has observed to be more resistant against hydrolysis, and reaction with calcium in higher concentrations will lead to better sizing as more reactive sizing agent is present when the sheets are formed. Slower hydrolysis of maleated vegetable oil also leads to a better stability of the respective positive zeta potential of the sizing agent emulsion particles. Those are better retained on the negatively charged fibres than the less positively charged emulsion particles containing only ASA. In addition, harmful deposits in the paper machines are reduced due to the improved hydrolytic stability and calcium ion tolerance, which means decreased maintenance times.

The combination of ASA and maleated vegetable oil provides an alternative to ASA, based on renewable resources and being independent of fossil based products. Thus, the present invention also provides the chance for the paper and board manufacturers to enhance their efforts towards a more environmentally compatible paper and board production.

BRIEF DESCRIPTION OF THE DRAWINGS

The invention will be described in more detail with reference to appended drawings, in which.

DETAILED DESCRIPTION OF THE INVENTION

Figure 1:
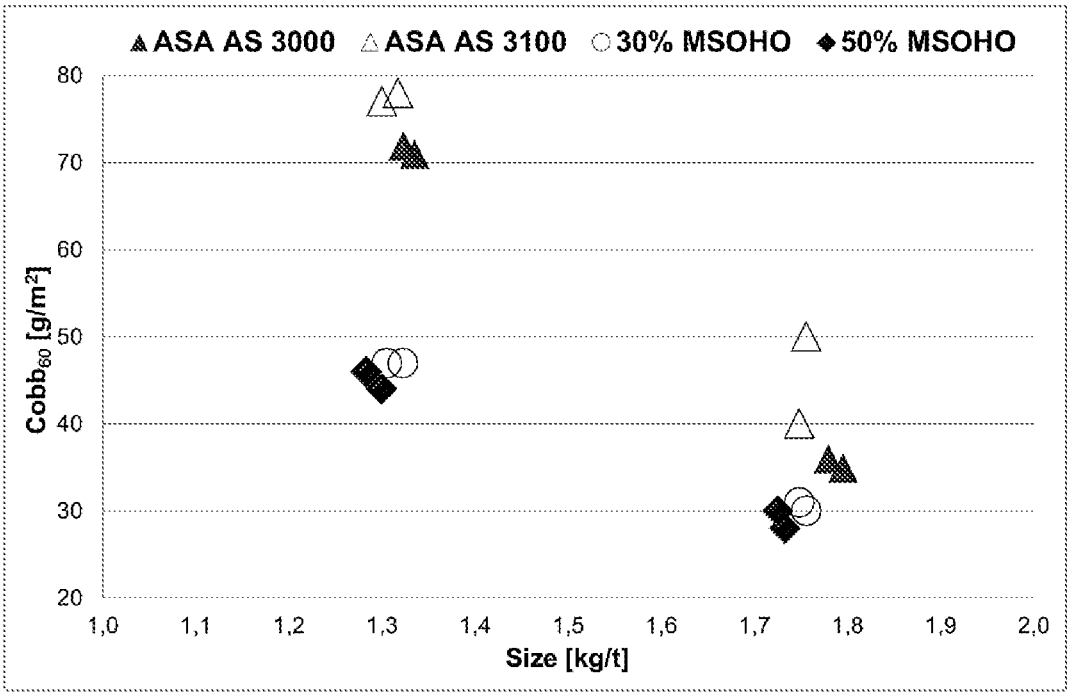
FIG. 1 shows the comparison of ASA sizing efficiency to various sizing agent blends according to the invention containing maleated vegetable oil.

By the term "size" or "sizing agent" is meant an active compound or a mixture of active compounds suitable for use in sizing paper, board or the like.

According to the present invention, a paper sizing agent is a blend which comprises, as the first component, a maleated vegetable oil and, as the second component, an alkenyl succinic anhydride (ASA).

The paper sizing agent according to the invention comprises 30-60 weight-% of maleated vegetable oil and more preferably about 30-50 weight-% of maleated vegetable oil.

The main constituent of a vegetable oil is triglyceride in which glycerol is esterified with three fatty acids. Typically, at least 50% by weight of the total fatty acids of the triglycerides are monounsaturated. Preferably at least 60% by weight, more preferably at least 70% by weight, and most preferably at least 80% by weight of the total fatty acids of the triglycerides of the vegetable oil are monounsaturated.

According to the present invention the vegetable oil of the maleated vegetable oil preferably originates from vegetable oil comprising rapeseed oil (including Canola oil), high oleic sunflower oil, high oleic safflower oil, olive oil or hazelnut oil or a mixture thereof. High oleic sunflower oil and rapeseed oil are especially preferred due to their very good sizing efficiency and low viscosity. Typical oleic acid contents of some suitable vegetable oils are as follows: high oleic sunflower oil 70-85%, rapeseed oil 51-67%, olive oil 58-83% and hazelnut oil 77-84%.

The maleated vegetable oil is formed by maleation, wherein maleic acid anhydride (MAA) is arranged to react with the vegetable oil, e.g. in a molar ratio of maleic acid anhydride to the triglyceride of at least 1:1, preferably at least 2:1, and more preferably at least 3:1. With higher ratios the reaction time is shortened and the content of residual oil decreases. One benefit of the shorter reaction time is that fewer polymers are produced as the time the reaction mixture is held at high temperature is reduced. The reaction temperature may typically be about 190-250° C. and the reaction time may typically be about 2-8.5 hours. Too long reaction times lead to the increase of the viscosity of the product. The excess MAA is distilled off after reaction at reduced pressure for example at 10 mbar for 1 hour. MAA can be added in one or several portions. It is preferred to carry out the reaction between vegetable oil and MAA in an inert atmosphere such as nitrogen or argon atmosphere which also suppresses the formation of unwanted polymer material. The reaction between MAA and the vegetable oil is preferably carried out in the presence of an antioxidant such as vitamin E or a phenolic compound, such as di-tert-butyl hydroxytoluene (BHT) or tert-butyl hydroxyanisole (BHA) or a mixture thereof. Typical amount of antioxidant or their mixture is about 0.02%. The antioxidant inhibits the formation of unwanted by-products, especially polymeric by-products. The formed polymeric by-products have a negative effect on the sizing performance and additionally cause runnability problems in the production process. The maleation step introduces an anchor group at the double bond of the hydrophobic triglyceride molecule that later is able to orientate towards cellulose in paper or board and thus enables the paper sizing emulsion according to the invention to become effective.

According to the invention the molar ratio of succinic anhydride to triglyceride in the maleated vegetable oil is preferably at least 1:1, more preferably at least 1.5:1, and most preferably at least 2:1.

According to an embodiment of the invention, the paper sizing agent comprising ASA and maleated vegetable oil is emulsified in an aqueous solution prior to the addition to the fibre stock. Thereby a paper sizing emulsion, which is an aqueous emulsion, is formed. According to an embodiment of the invention, the paper sizing agent is emulsified in a protective colloid. For this purpose typically a cationic modified starch solution with a consistency of 2.5-5% is used.

The concentration of the size(s) in the aqueous emulsion is preferable between 10% and 0.1%, more preferably between 5% and 0.5%. Prior to the addition of the paper sizing emulsion of the invention into the fibre stock the emulsion can be diluted for example in the proportion 1 part of emulsion to 10 parts of water. In one embodiment the paper sizing emulsion comprises from 0.1 weight-% to 10 weight-% of sizing agent, preferably from 0.5 weight-% to 5 weight-%.

For the preparation of the paper sizing emulsion with the maleated vegetable oil the same standard devices that are common with ASA can be used. Emulsifiers are not necessary for these processes, but their addition leads to smaller particles and therefore is beneficial. An especially preferred emulsifier is sodium di-octyl sulfosuccinate, because of its stability in cold maleated vegetable oils.

According to the present invention it is possible to emulsify the paper sizing agent on-site at the paper mill. This can be done without or with emulsifiers in the same way and with the same high shear devices as for ASA size.

The paper sizing agent according to the present invention may further comprise a fatty acid anhydride (FAA). The fatty acid anhydride preferably consists of two fatty acids, of fatty acid and acetic acid, of a fatty acid and a rosin acid, or a mixture thereof. The fatty acid of the FAA size is preferably derived from tall oil. According to an embodiment of the invention, the paper sizing agent comprises 0.1-30 weight-% of fatty acid anhydride (FAA), which is added to the maleated vegetable oil before mixing with alkenyl succinic anhydride (ASA). Typically, the fatty acid anhydride may be added to the blend of the paper sizing agent if there is need to decrease viscosity of the emulsion. However, the FAA might decrease the efficiency of the sizing emulsion, if the amount of the FAA in the emulsion exceeds 30 weight-%.

Additional agents conventionally used in paper manufacturing including aluminium salts such as aluminium sulphate or polyaluminium chloride and retention aids such as a cationic polymer may also be added to the fibre stock. The paper sizing emulsion according to the present invention may additionally comprise these additional reagents, but more preferably the aluminium salt such as aluminium sulphate or polyaluminium chloride is added separately to the fibre stock after the addition of the paper sizing emulsion.

In the present description, the term "fibre stock", into which the paper sizing agent according to the invention is incorporated, is understood as an aqueous suspension which comprises fibres and optionally fillers. The fibre stock may also be called fibre suspension, pulp slurry or pulp suspension.

According to the present invention, the fibre stock comprises at least 80 weight-%, and preferably at least 90 weight-% of recycled fibre material, calculated as dry. The paper sizing agent of the present disclosure also performs when using high amounts of recycled fibre materials, even up to 100 weight-%. According to a preferred embodiment of the invention, a paper sizing agent is used with the fibre stocks originates 100 weight-% of fibre material from the recycled fibres. In a preferred embodiment of the invention, the fibre stock does not contain fresh fibres.

Surprisingly it was also observed that a paper sizing agent of the present invention tolerated well a high calcium concentration of the fibre stock, which is common in paper or board production when using recycled fibre material comprising fillers, such as $CaCO_3$. Calcium concentration of the fibre stock may be expressed as mg CaO/l. High calcium concentration affects less the performance of the paper sizing agent according to the present invention comprising a blend of maleated vegetable oil and alkenyl succinic anhydride (ASA) compared to the performance of alkenyl succinic anhydride (ASA) alone. According to one preferable embodiment of the invention the paper sizing agent is used to treat fibre stock comprising at least 80 weight-%, and preferably at least 90 weight-% of recycled fibre material, calculated as dry, and having a calcium concentration of at least 500 mg/l expressed as CaO. In an embodiment according to the invention, the paper sizing agent is used to treat fibre stock originates 100 weight-% of fibre material from the recycled fibres and having a calcium concentration of at least 500 mg/l expressed as CaO. The paper sizing agent of the present invention performs well even at above mentioned elevated calcium load. According to an embodiment of the invention the fibre stock comprising recycled fibre material may have a Ca concentration of at least 550 mg/l expressed as CaO or at least 600 mg/l or even higher.

As understood by a skilled person, the conductivity of a fibre stock may fluctuate to some extent when a papermaking process is operated due to various reasons, e.g. due to fluctuation in the raw material quality or degree of water closure, i.e. level of fresh water make-up to replace existing effluent.

By conductivity, as used herein, is meant the conductivity of the fibre stock as measured at any point of time of normal operating conditions at the headbox of the papermaking process. It has been observed that the paper sizing agent of the present invention tolerates elevated and high conductivities and continues performing well even in high conductivities.

The paper sizing agent according to the invention may be added to thin or thick stock. Typically, a fibre stock having a consistency of above 20 g/l is called thick stock, before it is diluted with white water into thin stock. Thus, thin stock is here understood as a fibrous stock or furnish, which typically has consistency of below 20 g/l. According to an embodiment of the invention, a paper sizing agent is added to the fibre stock having consistency below 20 g/l. Typically, the paper sizing agent is emulsified prior to the addition in the fibre stock. A paper sizing emulsion according to the invention may optionally be further diluted with water, and then added to the fibre stock.

According to one preferable embodiment of the invention a paper sizing agent is used as internal sizing agent in paper or board manufacture when producing paper or board having a grammage in the range of 125-600 g/m$^2$, preferably 150-210 g/m$^2$ and using mostly of the recycled fibres. According to an embodiment of the invention gypsum board paper, liner, kraft liner, test liner, sack paper, packing board or the like is manufactured by the method of the present invention. According to a preferred embodiment, a gypsum board paper is manufactured by the method of the present invention. The method according to the invention is also suitable for other paper and board grades having a grammage from 125 to 600 g/m$^2$, preferably from 150 to 210 g/m$^2$ and they may be based about 100% on recycled fibres, or to any possible blend between primary fibres and at least 80% of recycled fibres. The method of the invention is especially suitable for the paper or board grades which require good water resistance.

An amount of the paper sizing agent to be added to fibre stock may vary depending on the application. Due to the high amount of recycled fibres in the fibre stock and the hard sizing degree required, typical amounts of paper sizing agent is about 2-7 kg/t (active content/paper ton) and preferably about 3-5 kg/t (active content/paper ton).

The invention relates to a method for the manufacturing of paper, board or the like from a fibre stock treated with the paper sizing agent according to the invention, wherein the treated fibre stock is formed into a fibrous web and drained. The steps of forming a fibre stock, draining and drying may be carried out in any suitable manner generally known to those skilled in the art.

EXPERIMENTAL PART

A better understanding of the present invention may be obtained through the following examples which are set worth to illustrate, but are not to be construed as the limit of the present invention.

In preparation of a machine trial, lab sheets were prepared using the waste paper thin stock form a board producer. The fibre stock (Board stock) was characterized and was found to have Ca concentration of 538 mg/l expressed as CaO and a poor retention on the Rapid Köthen while other parameters were similar to the standard stock system used for Lab sheets consisting of long and short fibres in a weight ratio of 70:30 with 0.25 ground calcium carbonate (GCC) and a dry content of 1.25%. The properties of the fibre stocks are presented in Table 1.

TABLE 1

The properties of the board stock and the standard stock.

| | pH | Dry Content (%) | Ash Content (%) | Retention (%) |
|---|---|---|---|---|
| Board stock | 7.8 | 1.2 | 0.21 | 45.7% |
| Standard stock | 7.8 | 1.3 | 0.14 | 96.4 |

The paper sizing emulsions were prepared using an Ultra Turrax and emulsifying 1% of the respective sizing agent in a cationic starch solution having 4% dry content for 2 min at 70° C. and 10 000 rpm. These emulsions are diluted 1:10 with osmosis water and the respective amounts are added to the fibre stock. The retention system of the given board producer was used. After the sheet production on the Rapid Köthen the sheets are dried with a photo drier (40 sec) and then conditioned at 21° C. 55% RH for 40 min before measuring the $Cobb_{60}$ values. The $Cobb_{60}$ value indicates whether board has the ability to absorb water. A high Cobb value indicates the ability to absorb water, a low $Cobb_{60}$ value indicates resistance to absorbing water.

The sizing agent blends used in the experiments are presented in Table 2. All blends are prepared with an active liquid alkenyl succinic anhydride (ASA). MSOHO refers to a maleated vegetable oil. In fatty acid anhydride (FAA) containing blends, 25% FAA was always added to the pure maleated oil before mixing the blend with ASA. Therefore the ratio of renewable size to ASA remains the same in the blends 30% MSOHO and 30% MSOHO+FAA as well as 50% MSOHO and 50% MSOHO+FAA.

TABLE 2

The sizing agent blends.

| Sizing agent blend | Viscosity (25° C.) mPas | Ratio of ASA:MSOHO |
|---|---|---|
| ASA + 30% MSOHO | 592 | 7:3 |
| ASA + 30% MSOHO + 25% FAA | 367 | 7:3 |
| ASA + 50% MSOHO | 962 | 1:1 |
| ASA + 50% MSOHO + 25% FAA | 496 | 1:1 |
| ASA (AS3100) | — | — |
| ASA (AS3100) | — | — |

Figure 2:
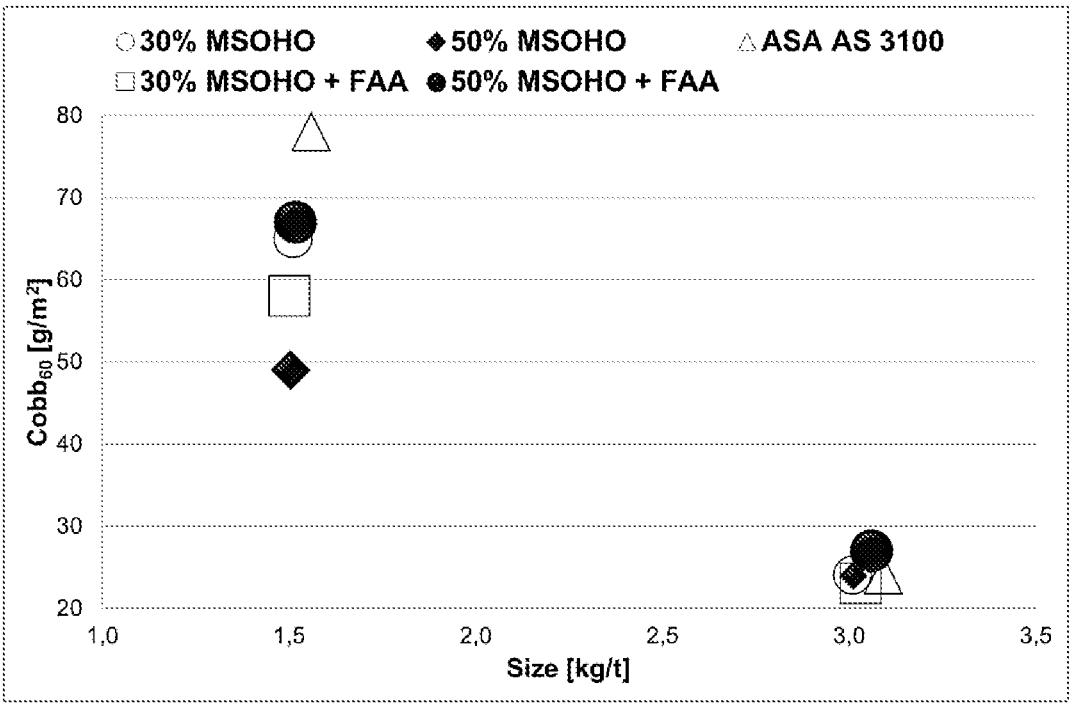
FIG. 2 shows the results of sizing efficiency of the sizing agent blends according to the invention with fatty acid anhydride (FAA).

FIG. 1 presents the comparison of ASA sizing efficiency to various blends containing maleated vegetable oils. From the results presented in FIG. 1, it can be seen that blends containing maleated vegetable oil were more resistant against wetting (lower $Cobb_{60}$ value) than ASA sized sheets. To verify these findings and also include blends with fatty acid anhydride (FAA) the test was repeated. The results are showed in FIG. 2, and it can be noticed that at 3.0 kg/t all sheets were equally sized irrespective of the blend used, but at 1.5 kg/t all blends containing maleated oil had a better sizing efficiency. The results show that maleated vegetable oil boots the ASA sizing efficiency for the certain fibre stocks having a high calcium load.

The invention claimed is:

1. A manufacturing method of a paper or a board having a grammage in a range of 125-600 g/m$^2$, comprising:

introducing a fibre stock comprising at least 80 weight-% of recycled fibre material, calculated as dry, and having calcium concentration of at least 500 mg/l, expressed as CaO;

adding a paper sizing agent comprising an alkenyl succinic anhydride (ASA) and at least 20-60 weight-% of maleated vegetable oil to the fibre stock; and forming the fibre stock into a fibrous web and drained to the paper or the board.

2. The method according to claim 1, wherein the fibre stock comprises at least 90 weight-% of recycled fibre material, calculated as dry.

3. The method according to claim 1, wherein the paper sizing agent comprises 30-60 weight % of the maleated vegetable oil.

4. The method according to claim 1, wherein the paper sizing agent additionally comprises a fatty acid anhydride (FAA).

5. The method according to claim 4, further comprising adding 0.1-30 weight-% of the fatty acid anhydride (FAA) to the maleated vegetable oil before mixing with the alkenyl succinic anhydride (ASA).

6. The method according to claim 1, wherein the maleated vegetable oil of the paper sizing agent originates from vegetable oil comprising rapeseed oil, high oleic sunflower oil, high oleic safflower oil, olive oil or hazelnut oil or a mixture thereof.

7. The method according to claim 1, wherein at least 50% by weight of total fatty acids of triglycerides of the maleated vegetable oil are monounsaturated.

8. The method according to claim 7, wherein at least 60% by weight of the total fatty acids of the triglycerides of the maleated vegetable oil are monounsaturated.

9. The method according to claim 8, wherein at least 70% by weight of the total fatty acids of the triglycerides of the maleated vegetable oil are monounsaturated.

10. The method according to claim 9, wherein at least 80% by weight of the total fatty acids of the triglycerides of the maleated vegetable oil are monounsaturated.

11. The method according to claim 1, further comprising emulsifying the paper sizing agent prior to the addition in the fibre stock.

12. The method according to claim 1, wherein the paper sizing agent is added in an amount of 2-7 kg/t (active content/paper ton).

13. The method according to claim 12, wherein the paper sizing agent is added in an amount of 3-5 kg/t (active content/paper ton).

14. The method according to claim 1, wherein the paper or the board has a grammage in a range of 150-210 g/m$^2$.

15. The method according to claim 1, wherein the fibre stock comprises 100 weight-% of recycled fibre material, calculated as dry.

16. The method according to claim 1, wherein the paper sizing agent comprises 30-50 weight-% of the maleated vegetable oil.

17. A paper or board product having a grammage in a range of 125-600 g/m$^2$ manufactured by the method according to claim 1.

18. The paper or board product according to claim 17, wherein the paper or board product is gypsum board paper, liner, kraft liner, test liner, sack paper or packing board.

19. The paper or board product of claim 17, having a grammage in a range of 150-210 g/m$^2$ manufactured by the method according to claim 1.

* * * * *